United States Patent [19]

Tasaka et al.

[11] 4,252,658

[45] Feb. 24, 1981

[54] SOLID LUBRICANT

[75] Inventors: Akira Tasaka; Yosiaki Murakami, both of Takatsuki, Japan

[73] Assignee: Sumitomo Chemical Company, Limited, Japan

[21] Appl. No.: 509,950

[22] Filed: Sep. 27, 1974

[30] Foreign Application Priority Data

Sep. 29, 1973 [JP] Japan ..... 48-109945

[51] Int. Cl.[3] ..... C10M 7/04; C10M 1/10

[52] U.S. Cl. ..... 252/29

[58] Field of Search ..... 252/12, 12.2, 12.4, 252/12.6, 25, 29; 423/445, 449

[56] References Cited

U.S. PATENT DOCUMENTS

| | | | |
|---|---|---|---|
| 1,828,009 | 10/1931 | Westhafer | 423/445 |
| 2,486,826 | 11/1949 | Decepoli | 252/12.4 |
| 2,487,640 | 11/1949 | Decepoli | 252/12.4 |
| 2,609,256 | 9/1952 | Baker et al. | 423/448 X |
| 3,264,073 | 8/1966 | Schmitt | 264/29 |
| 3,549,531 | 12/1970 | Santt | 252/12 |
| 3,786,134 | 1/1974 | Amagi et al. | 264/29 |
| 3,830,740 | 8/1974 | Amagi et al. | 423/445 |
| 3,847,825 | 11/1974 | Lavik et al. | 252/12 |
| 3,956,436 | 5/1976 | Honda et al. | 252/12 X |

*Primary Examiner*—Delbert E. Gantz
*Assistant Examiner*—Irving Vaughn
*Attorney, Agent, or Firm*—Birch, Stewart, Kolasch & Birch

[57] ABSTRACT

A solid lubricant comprising a substantially amorphous carbon micro-sphere selected from carbon micro-beads and carbon micro-balloons having a particle size of 0.1 to 1,000$\mu$ and a specific gravity of the particle of 0.2 to 2.0, which has excellent low frictional coefficient and wearing resistance.

7 Claims, No Drawings

SOLID LUBRICANT

The present invention relates to a solid lubricant comprising a substantially amorphous carbon micro-sphere.

It has, hitherto, been known to add a solid lubricant such as molybdenum disulfide, tungsten disulfide, powdery graphite, or P.T.F.E. (polytetrafluoroethylene), a sulfur compound, a chlorine compound, or a phosphorus compound to a working surface and thereby to enhance the lubricating properties of the surface, such as the prevention of scoring of the contacting surface owing to frictional heat and the improvement of the wearing resistance at a high temperature and under a high pressure. However, the substance mixed with such conventional solid lubricants is easily affected by the contact pressure, the slide velocity, the temperature, the atmosphere or the like and a sufficiently high PV value (the value of pressure×velocity) cannot be obtained. For instance, when a sulfur compound, a chlorine compound or a phosphorus compound is added, the additive and the contacting surface are chemically reacted by the frictional heat to induce an oxidation and corrosion of the contacting surface, which results in the increase of the wear. Besides, when molybdenum disulfide or tungsten disulfide is used, an oxidation or change of properties of the contacting surface occurs and thereby corrosion or oxidates are produced, which cause the wear. When an organic high molecular weight material such as P.T.F.E. is used, the product has inferior heat conductivity and heat stability. Moreover, when a powdery graphite is used, it is said that the lubricating properties are deteriorated unless a water absorbing layer is contained in the molecular surface, and on the other hand, a corrosion of the metal surface is induced in the presence of water.

Besides, these conventional solid lubricants are inferior in the wearing resistance, and therefore, if a glassy powder or fiber or an amorphous carbon having an insufficient crystalline structure is added, the wearing resistance of the product is improved but the frictional coefficient becomes disadvantageously high.

The present inventors have conducted studies to find a new solid lubricant having none of the defects as mentioned above, and have found that a micro-sphere comprising a substantially amorphous carbon shows an extremely improved wearing resistance and lowers the frictional coefficient and further improves the chemical resistance, heat resistance and heat conductivity.

An object of the present invention is to provide a solid lubricant having a superior low frictional coefficient and wearing resistance.

Another object of the invention is to provide a micro-sphere comprising a substantially amorphous carbon which is useful as a solid lubricant.

A further object of the invention is to provide a use of amorphous carbon micro-spheres as a solid lubricant.

These and other objects of the invention will be apparent from the description hereinafter.

The amorphous carbon micro-sphere of the present invention means a micro-bead having a particle size of 0.1 to 1,000μ, preferably 0.5 to 200μ and a specific gravity of 1.3 to 2.0, preferably 1.3 to 1.7 or a micro-balloon having a particle size of 0.1 to 1,000μ, preferably 0.5 to 200μ and a specific gravity of 0.2 to 1.3, preferably 0.7 to 1.1, which comprises carbons having an insufficiently grown crystalline structure and being not graphitized.

The carbon micro-bead may be produced by carbonizing a micro-bead which can be carbonized by heating. The carbon micro-balloon may be produced by carbonizing a micro-balloon having a shell which can be carbonized by heating. The inner part of the starting micro-balloon may comprise a gas, a liquid or solid which can be decomposed by carbonization, or a lamellar structure thereof. The carbonization temperature may be up to a temperature at which no graphitization of the carbon components substantially occurs, and the maximum carbonization temperature is usually 2,000° C. The preferred carbonization temperature may be in a range of 800° to 1,500° C.

The carbonizable materials useful for the starting material may be a thermosetting resin (e.g. pitches, or phenol resins), a crosslinkable high molecular weight compound (e.g. styrene-divinylbenzene copolymer) or an organic high molecular weight compound which is chemically treated and thereby made infusible.

The examples of the organic high molecular weight compounds used as the starting material are as follows:

(1) A polymer having the following general formula:

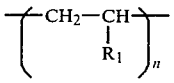

(I)

wherein $R_1$ is hydrogen, hydrocarbon, substituted hydrocarbon, hydrocarbonoxy, substituted hydrocarbonoxy, halogen, cyano, hydroxy, $—OCOR_2$ or $—COOR_2$; $R_2$ is hydrogen, hydrocarbon or substituted hydrocarbon; and n is an integer which shows the degree of polymerization. The suitable examples of the polymer may be polystyrene, polyethylene, polypropylene, polyvinyl alcohol, polyvinyl acetate, polyvinyl chloride, polyvinyl ethyl ether, polyacrylic acid, polymethyl acrylate, polyacrylonitrile, or the like.

(2) A polymer having the following general formula:

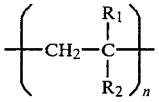

(II)

wherein $R_1$ and $R_2$ are each hydrocarbon, substituted hydrocarbon, hydrocarbonoxy, substituted hydrocarbonoxy, halogen, cyano, $—OCOR_3$ or $—COOR_3$; $R_3$ is hydrogen, hydrocarbon or substituted hydrocarbon; and n is an integer which shows the degree of polymerization. The suitable examples of the polymer may be polyisobutylene, poly(α-methylstyrene), polyvinylidene chloride, polymethyl methacrylate, polycyanovinylidene, or the like.

(3) A polymer of the following general formula:

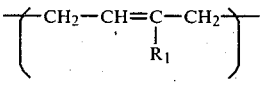

(III)

wherein $R_1$ is hydrogen, hydrocarbon, substituted hydrocarbon, halogen, cyano, $—OCOR_4$ or $—COOR_4$;

$R_4$ is hydrogen, hydrocarbon, or substituted hydrocarbon; and n is an integer which shows the degree of polymerization. The suitable examples of the polymer may be polybutadiene, polyisoprene, polychloroprene, or the like.

(4) A copolymer of two or more kinds of monomers for the above polymers (I), (II) and (III), or a graft copolymer thereof. The suitable examples of the copolymer may be ethylene-propylene copolymer, ethylene-propylene-dicyclopentadiene terpolymer, styrene-acrylonitrile copolymer, styrene-acrylonitrile-butadiene terpolymer, styrene-butadiene copolymer, butyl acrylate-acrylonitrile copolymer, vinyl chloride-ethylene copolymer, or the like.

(5) A polyester, such as polyethylene terephthalate.

(6) A polyamide, such as polycapramide (i.e. nylon-6), or polyhexamethylenedipolyamide (i.e. nylon-66).

(7) A polyurethane, such as polyethylene methylenebis(4-phenyl)carbamate.

(8) A polyalkylene ether, such as polyoxymethylene, or polyethylene oxide.

(9) A polyphenylene oxide, such as poly(2,6-dimethyl-1,4-phenylene oxide).

(10) A polymer containing formaldehyde as a monomer unit, such as xylene-formaldehyde polymer, styrene-formaldehyde polymer, phenol-formaldehyde polymer, melamine-formaldehyde polymer, or urea-formaldehyde polymer.

(11) A polymer containing bisphenol A as a monomer unit, such as bisphenol A-epichlorohydrin polymer, or bisphenol A-phosgene polymer.

(12) An unsaturated polyester obtained from a monomer such as diallyl phthalate.

(13) Other polymers, such as polyphenylane, polyxylene, polybenzimidazole, or polybenzimidazoimide.

Among the above carbonizable materials, polystyrene, polystyrene-divinylbenzene copolymer, pitches, polyacrylonitrile or copolymers thereof and polyphenylene oxide are preferable since they can be easily made infusible and can give the desired carbon micro-sphere in a high carbonization yield. The most preferred material is polystyrene or polystyrene-divinylbenzene copolymer.

The chemical treatment for making the organic high molecular weight compounds infusible includes the treatment with oxygen, ozone, sulfuric anhydride, sulfur dioxide, sulfuric acid, chlorosulfonic acid, nitrogen dioxide, nitrogen monoxide, chlorine, bromine, hydrogen peroxide, or the like, and further any other chemical treatment may be included.

Among the above chemical treatments, the treatment with sulfuric anhydride, sulfuric acid, chlorosulfonic acid, nitrogen dixode or nitrogen monoxide is preferable since it can make the carbonizable material infusible within a shorter time. The most preferred one is the treatment with sulfuric anhydride, sulfuric acid or chlorosulfonic acid.

The substantially amorphous carbon micro-sphere of the present invention is a carbon product, and therefore, it is chemically stable and has a high heat resistance and excellent lubricating properties. Furthermore, since it is spherical, it shows excellent dispersibility to the carrier, and the molded product thereof has excellent mechanical strength and thermal properties, and further, it shows improved wearing resistance and a low frictional coefficient. Besides, the use of the micro-balloon provides a significant saving of weight in the product. Thus, the substantially amorphous carbon micro-sphere of the present invention has superior properties as a solid lubricant.

The carrier on which the present carbon micro-sphere is carried includes one or more members selected from the group consisting of lubricating oil and fats, synthetic resins and metals. The lubricating oil and fats may be a mineral oil, or animal and vegetable oil or fat, a synthetic oil, or the like. The synthetic resins may be phenol resins, ABS resins (i.e. acrylonitrile-butadiene-styrene resin), acetal resins, polycarbonate resins, epoxy resins, DVB resins (i.e. divinylbenzene resin), furan resins, fluorine resins, polyethylenes, silicone resins, methacrylic resins, nylons, melamine resins, acrylic resins, synthetic rubbers, asphalts, pitches, tars, or the like. The metals may be bronze, iron, lead, gun metal, stainless steel, or the like.

The carbon micro-sphere of the present invention is added to the carrier in an amount of 3 to 60% by volume, preferably 5 to 40% by volume on the basis of the whole volume of the product. When the present carbon micro-sphere is added in an amount smaller than the above range, the wearing resistance of the product is less improved, and on the other hand, when the amount is larger than the above range, the frictional coefficient of the product is disadvantageously increased.

The dispersion of the present solid lubricant comprising a substantially amorphous carbon micro-sphere into the carrier may be carried out by a conventional method. For instance, the carbon micro-sphere may be added to an appropriate carrier suitable for the intended use and the mixture is agitated. If necessary, to the resulting mixture are added other additives, and thereafter, it is subjected to various treatments such as condensing the solvent, heating, molding, sintering or processing according to conventional methods to give the desired product. As the other additives, there may be used a solid lubricant (e.g. powdery graphite or molybdenum disulfide), a fiber having an aspect ratio (i.e. length:diameter) of 10:1 or more (e.g. glass fiber or carbon fiber), or a reinforcing additive (e.g. woodflour or asbestos), which may be used alone or in a mixture thereof.

When the solid lubricant of the invention is dispersed into a lubricating oil and fat, the sliding resistance at the sliding part of the machine can be decreased and the lubricating properties owing to the extreme pressure of the machine parts is improved, and therefore, the lubricating action can be maintained for a long time. Besides, when a synthetic resin or a metal is used as the carrier, the low frictional coefficient of the product can be maintained in a wide range of temperature and the product shows excellent wearing resistance and further excellent mechanical strength.

Thus, the product prepared by using the solid lubricant comprising a substantially amorphous carbon micro-sphere has extremely excellent properties and is useful as a lubricating oil used for an internal combustion engine, a conductive apparatus, a gear, a plain bearing, or the like, or for parts to be lubricated (e.g. packing material, sealing material, sealing ring, piston ring, or oil-free lubricating parts).

The present invention is illustrated by the following Examples but is not limited thereto.

REFERENCE EXAMPLE 1

Polystyrene bead having an average particle size of 70μ (50 parts by weight) is charged into a flask and the temperature thereof is raised to 80° C. under nitrogen gas. While rotating the flask, to the bead is added a sulfuric anhydride, wherein to the liquid sulfuric anhydride is bubbled dry nitrogen gas at 30° C. for 4 hours in a velocity of 0.7 liter/min. After the reaction, the modified polystyrene bead thus obtained is carbonized by heating under nitrogen gas while raising the temperature at a rate of 300° C./hour up to 1,000° C. to give amorphous carbon micro-balloon (average particle size: 70μ; thickness of the shell: 10μ; specific gravity of the particle: 0.96).

REFERENCE EXAMPLE 2

Polystyrene bead having an average particle size of 70μ is added to 30% fuming sulfuric acid, and the mixture is agitated at room temperature for 30 minutes and then filtered, washed and dried. The modified polystyrene bead thus obtained is carbonized by heating while raising the temperature at a rate of 300° C./hour up to 1,000° C. to give amorphous carbon micro-bead (average particle size: 70μ; specific gravity of the particle: 1.7).

EXAMPLE 1

The amorphous carbon micro-balloon (14 parts by weight) obtained in the Reference Example 1 is mixed with phenol resin (non-volatile fraction, 22 parts by weight) and graphite (64 parts by weight). After drying, the mixture is filled into a mold and then cured at 90° C. for 30 minutes and further at 180° C. for one hour under a pressure of 100 kg/cm$^2$ to give a product (Product D). In the same manner as above, another product (Product E) is obtained except that the amount of the starting materials is changed.

As Comparative Examples, there are obtained Product A without amorphous carbon micro-balloon, and Product B and C using molybdenum disulfide.

The proportion of the starting materials of these products are shown in Table 1.

TABLE 1

| | Phenol resin (part by weight) | Graphite (part by weight) | Molybdenum disulfide (part by weight) | Carbon micro-balloon (part by weight) |
|---|---|---|---|---|
| Comparative Example | | | | |
| A | 20 | 80 | — | — |
| B | 16 | 45 | 39 | — |
| C | 14 | 29 | 57 | — |
| Example 1 | | | | |
| D | 22 | 64 | — | 14 |
| E | 25 | 50 | — | 25 |

Besides, the ratio by volume, mechanical strength, wear volume and frictional coefficient of each product are shown in Table 3. As is made clear from the data, the product of the present invention is superior to the products using graphite or molybdenum disulfide in the mechanical strength, wear volume and frictional coefficient and further has a lighter weight.

EXAMPLE 2

The amorphous carbon micro-bead obtained in the Reference Example 2 is molded in the same manner as described in Example 1 to give Products F and G. The proportion of the starting materials are shown in Table 2.

TABLE 2

| | Phenol resin (part by weight) | Graphite (part by weight) | Carbon micro-balloon (part by weight) |
|---|---|---|---|
| Example 2 | | | |
| F | 22 | 59 | 19 |
| G | 22 | 44 | 34 |

Besides, the ratio by volume, mechanical strength, wear volume and frictional coefficient of the products are shown in Table 3. These products are superior to the products using graphite or molybdenum disulfide in the mechanical strength, wear volume and frictional coefficient.

In the following Table 3, the wear volume and the frictional coefficient are measured by the following method:

Measurement of wear volume:

By using an Ogosi-type rapid abrasion testing machine, friction velocity: 118 m/min.

final load: 2.1 kg friction distance: 200 m

Measurement of frictional coefficient:

By using a small bearing testing machine (made by Toyo Seiki K.K.), sliding velocity: 60 m/min.

load: 7 kg/cm$^2$

EXAMPLE 3

The amorphous carbon micro-balloon (30 parts by weight) obtained in the Reference Example 1 is mixed with P.T.F.E. (70 parts by weight) at a low temperature with agitation, and the mixture is pre-molded at room temperature and under a pressure of 200 kg/cm$^2$ and then sintered by heating while raising the temperature at a rate of 100° C./hour up to 380° C. and allowing it

TABLE 3

| | Proportion of the starting materials (by volume) | | | Properties | | | | |
|---|---|---|---|---|---|---|---|---|
| | Phenol resin | Graphite | Filler | Specific gravity | Flexural strength kg/mm$^2$ | Compression strength kg/mm$^2$ | wear volume $\times 10^{-3}$ mm$^3$ | Frictional coefficient |
| Comparative Example | | | | | | | | |
| A | 32 | 68 | — | 1.95 | 5.0 | 8.0 | 88 | about 0.27 |
| B | 33 | 48 | 19 | 2.44 | 4.8 | 13.0 | 43 | about 0.26 |
| C | 33 | 34 | 33 | 2.78 | 4.6 | 11.0 | 25 | about 0.25 |
| Example 1 | | | | | | | | |
| D | 31 | 46 | 23 | 1.69 | 5.3 | 13.0 | 9.9 | about 0.22 |
| E | 31 | 32 | 37 | 1.50 | 5.5 | 15.0 | 6.6 | about 0.21 |
| Example 2 | | | | | | | | |
| F | 31 | 46 | 23 | 1.83 | 5.4 | 16.0 | 9.3 | about 0.23 |
| G | 31 | 32 | 37 | 1.74 | 5.7 | 18.0 | 4.2 | about 0.22 |

to stand at this temperature for 4 hours to give a product. In the same manner as above, another product is obtained using 10 parts by weight of the carbon micro-balloon instead of 30 parts by weight and further using 90 parts by weight of P.T.F.E. instead of 70 parts by weight.

As a Comparative Example, a product is produced by using P.T.F.E. only in the same manner as above.

On these products, the wear weight and frictional coefficient are measured by using a Suzuki type friction testing machine (load: 9 kg/cm$^2$; sliding velocity: 6 m/min.). The results are shown in Table 4. The product of the present invention has an extremely improved wear weight and lower frictional coefficient.

TABLE 4

| | Wear weight mg/360 m | Frictional coefficient |
|---|---|---|
| P.T.F.E. only | 40 | 0.07–0.10 |
| 10% carbon micro-balloon + P.T.F.E. | 1 | 0.06–0.08 |
| 30% carbon micro-balloon + P.T.F.E. | 0 | 0.04–0.06 |

EXAMPLE 4

An amorphous carbon micro-bead (average particle size: 5$\mu$; specific gravity of the particle: 1.7) is produced by using polystyrene having an average particle size of 5$\mu$ in the same manner as described in Reference Example 2.

The amorphous carbon micro-bead (10% by weight) is dispersed into a lubricating oil for a land internal combustion engine (JIS K 2216).

As a Comparative Example, a product is produced without using the amorphous carbon micro-bead.

On the products, the critical load pressure is measured under the standard testing conditions (rotary velocity of ordinate axis: 200 rpm; testing steel sphere: $\frac{3}{4}$" steel sphere; load velocity: 0.5 kg/min.) by using four sphere type wear testing machines. The results are shown in Table 5. As is made clear from the results, the product of the present invention shows an extremely improved critical load pressure.

TABLE 5

| | Critical load pressure kg/cm$^2$ |
|---|---|
| Comparative Example | 3.5 |
| Example 4 | 10.0 |

What is claimed is:

1. A lubricating composition consisting essentially of substantially amorphous non-graphitized carbon micro-spheres having a particle size of 0.1 to 1,000 microns and a specific gravity of 0.2 to 2.0 dispersed in a carrier selected from the group consisting of lubricating oils and fats, synthetic resins and metals.

2. The lubricating composition according to claim 1, wherein the carbon micro-spheres comprise carbon micro-balloons having a particle size of 0.1 to 1,000 microns and a specific gravity of 0.2 to 1.3.

3. The lubricating composition according to claim 1, wherein said carbon micro-spheres are produced by treating a starting material selected from the group consisting of polystyrene and polystyrene-divinylbenzene copolymer with a member selected from the group consisting of sulfuric anhydride, sulfuric acid and chlorosulfonic acid in order to make said starting material infusible, and then carbonizing the resulting infusible material at a temperature of from 800° to 1,500° C. to give said carbon microspheres.

4. The lubricating composition according to claim 1, wherein the carbon micro-spheres are dispersed in said carrier in an amount of 3 to 60% by volume on the basis of the total volume of said composition.

5. The lubricating composition according to claim 1, wherein the particle size of said carbon micro-spheres is 0.5 to 200 microns.

6. The lubricating composition according to claim 4, wherein the amount of the carbon micro-spheres dispersed in said carrier is from 5 to 40% by volume.

7. The lubricating composition according to claim 1, wherein the carrier is a synthetic resin.

* * * * *